US008690619B2

(12) United States Patent
Meinke

(10) Patent No.: US 8,690,619 B2
(45) Date of Patent: Apr. 8, 2014

(54) STEERING APPARATUS FOR OUTBOARD MOTOR

(75) Inventor: James Meinke, Melrose, MN (US)

(73) Assignee: Marinetech Products, Inc., White Bear Lake, MN (US)

( * ) Notice: Subject to any disclaimer, the term of this patent is extended or adjusted under 35 U.S.C. 154(b) by 108 days.

(21) Appl. No.: 13/603,731

(22) Filed: Sep. 5, 2012

(65) Prior Publication Data

US 2014/0065902 A1 Mar. 6, 2014

(51) Int. Cl.
*B63H 5/125* (2006.01)
*B63H 20/08* (2006.01)

(52) U.S. Cl.
USPC ..... 440/62; 114/144 R

(58) Field of Classification Search
USPC ..... 440/53, 55, 58, 59, 60, 61 R, 61 S, 62, 440/63; 114/144 R, 144 RE, 144 A
See application file for complete search history.

(56) References Cited

U.S. PATENT DOCUMENTS 3,606,858 A * 9/1971 Edwards et al. ..... 440/62
4,735,165 A * 4/1988 Baba et al. ..... 440/62
7,666,039 B2 2/2010 Zeim

* cited by examiner

*Primary Examiner* — Lars A Olson

(74) *Attorney, Agent, or Firm* — Howson & Howson LLP

(57) ABSTRACT

In an outboard motor steering apparatus, a stiff but flexible cable is wound on a reel driven by a reversible motor. The cable extends from a housing containing the reel and connects to a rod within the tilt tube of an outboard motor. The rod is in turn linked to the outboard motor so that steering of the outboard motor can be accomplished by winding the cable onto, and unwinding the cable from, the reel. The cable is guided by a bent channel within the housing so that it extends from a narrow part of the housing located aft of the reel.

12 Claims, 3 Drawing Sheets

Fig. 1
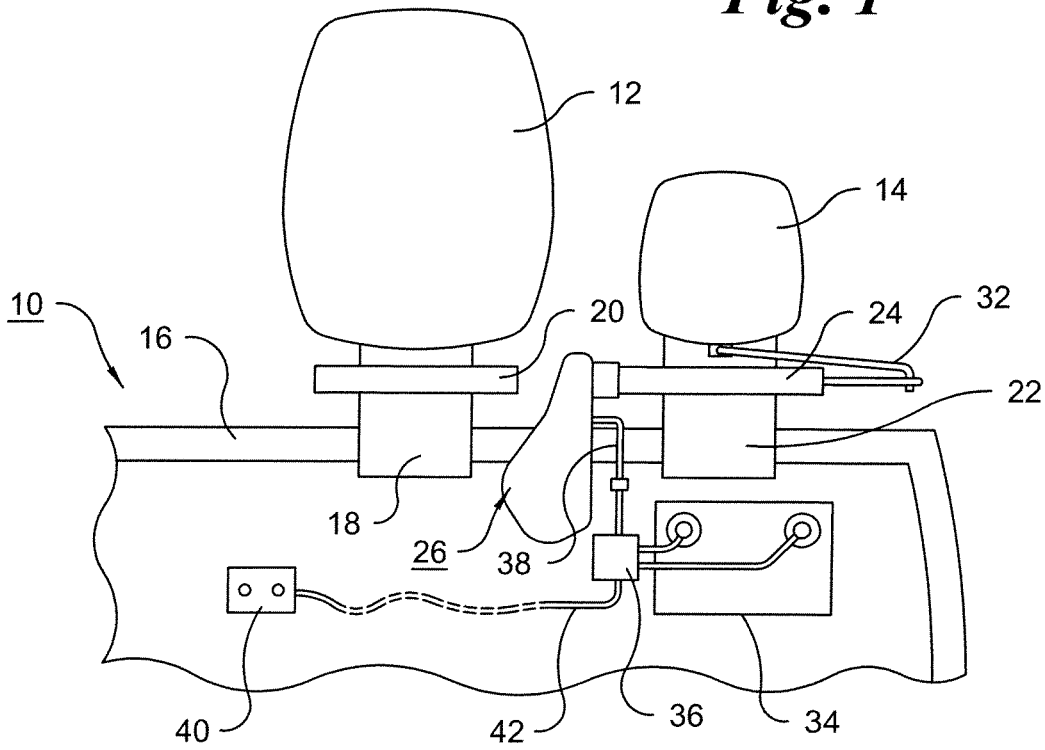
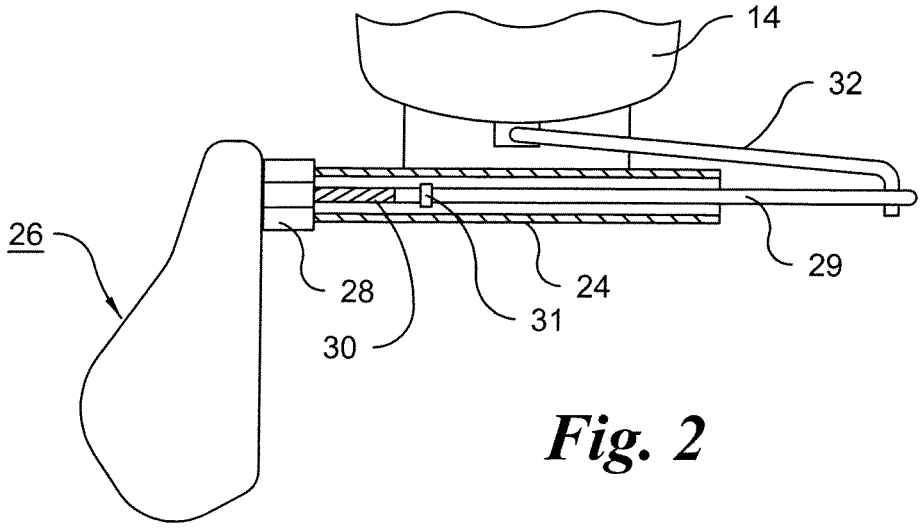
Fig. 2

STEERING APPARATUS FOR OUTBOARD MOTOR

FIELD OF THE INVENTION

This invention relates to marine propulsion, and particularly to an apparatus for steering an outboard motor that can be controlled from a location remote from the tiller.

BACKGROUND OF THE INVENTION

In fishing, especially on lakes, it is common to use a boat equipped with two outboard motors, one a large, motor for high speed propulsion, and the other a smaller motor for propelling the boat at low speed while trolling.

When trolling, it is important to be able to steer the boat both to avoid obstacles, and to maneuver the boat to circle schools of fish and to make more effective use of fishing rods and fish-retrieval nets. The boat can be steered by manipulation of a tiller attached to the battery-powered motor, but this requires the operator to be remain seated at the stern where he may have difficulty spotting fish and managing fishing equipment. It is desirable to be able to steer the boat from any of several locations on the boat, and to this end various remote steering devices have been utilized. One such device is described in U.S. Pat. No. 7,666,039, granted Feb. 23, 2010, the disclosure of which is incorporated by reference. In U.S. Pat. No. 7,666,039, a steering control is attached to one end of the tilt tube of an outboard motor. A linear actuator in the steering control is connected to a rod that extends through the tilt tube. The other end of the rod is linked to the motor, and linear actuator pushes and pulls the rod, steering the motor.

The linear actuator comprises a rotating electric motor that operates a worm gear in mesh with a toothed wheel that in turn operates a pinion in mesh with a rack that extends into the tilt tube. The rack needs to be long enough to steer the outboard motor through its full range, and the dimension of the steering control housing in the direction of rack movement needs to be sufficient to accommodate the rack when the rack is fully withdrawn.

It is convenient and desirable to locate the steering control described above between the larger motor and the smaller trolling motor. However, the large motor will normally be located at the center of the transom and the trolling motor offset to one side. Especially in a small boat having a narrow transom, the trolling motor will be positioned close to the large motor so that no part of the steering control extends beyond the ends of the transom where it could be damaged easily by contact with pilings, buoys or the like. In a boat having a wider transom, the trolling motor is also preferably positioned as close as possible to the center of the transom in order to minimize the drag caused when the trolling motor is steered to counteract yaw. The space required for a rack and pinion-type steering control makes it difficult to achieve these objectives. If the conventional rack and pinion-type steering control is positioned on the opposite end of the tilt tube of the trolling motor, the steering linkage then takes up a similarly large amount of space between the motors.

SUMMARY OF THE INVENTION

The invention addresses the above problems by eliminating the long rack of the rack and pinion mechanism of the prior art steering apparatus and instead using stiff but flexible cable wound on a motor-driven reel. The cable extends from a housing containing the reel and connects to a rod within the tilt tube of an outboard motor. The rod is in turn linked to the outboard motor so that steering of the outboard motor can be accomplished by winding the cable onto, and unwinding the cable from, the reel.

More particularly, the steering apparatus comprises a housing having a first fitting for attachment to one end of the tilt tube of an outboard motor. The first fitting has an internal passage for providing communication between the interior of the housing and the interior of a tilt tube to which the fitting is attached. A reel is mounted for rotation within the housing and driven by a reversible electric motor, which can be located with the housing through reduction gearing. A flexible cable, wound on the reel extends therefrom through the internal passage of the fitting. A part of the cable adjacent one end thereof is fixed to the reel, and a second fitting on the opposite end of the cable external to the housing is provided for attachment, within the tilt tube, to a rod protruding from the interior of the tilt tube through the opposite end thereof.

The cable has sufficient stiffness to exert a pushing force on the rod when the reel is rotated in a direction to unwind the cable therefrom so that by linking the protruding portion of the rod to the outboard motor, the outboard motor can be steered by operation of the reversible electric motor.

The reel can be constrained for rotation about a first axis in fixed relation to the housing, and the internal passage of the first fitting can extends from the interior of the housing to the exterior of the housing along a second axis spaced from the first axis. Preferably, this second axis can be disposed in a plane to which the first axis is perpendicular.

Where the first fitting is spaced from the reel, the housing preferably includes a cable guide passage constraining the portion of the cable extending from the reel to the first fitting to a predetermined path within the housing.

The housing may also include a curved internal wall extending around a portion of the perimeter of the reel in close relationship to the part of the flexible cable wound on the reel and constraining that part of the flexible cable wound on the reel against radial expansion as the cable is unwound from the reel.

The predetermined path can have a first part extending from a location adjacent the reel to an intermediate location and a second part extending from the intermediate location to a location adjacent the first fitting. Preferably, the first part of the predetermined path is longer than the second part thereof, the second part of the predetermined path has a curvature, and the radii of curvature of all parts of the second part are smaller than any radius of curvature of the first part.

Where the reel is constrained for rotation about a first axis in fixed relation to the housing, and the internal passage of the first fitting extends from the interior of the housing to the exterior of the housing along a second axis spaced from the first axis, and the second axis is disposed in a plane to which the first axis is perpendicular, the housing is preferably tapered. That is, the dimension of the housing along the second axis is narrower than the dimension of the housing along a direction parallel to the second axis at the location of the first axis.

Advantages of the invention over prior art outboard steering devices will be apparent from the following description when read in conjunction with the drawings.

BRIEF DESCRIPTION OF THE DRAWINGS

FIG. 1 is a schematic top plan view of the stern of an outboard motor-propelled vessel showing the steering apparatus of the invention installed on a trolling (or "kicker") motor and located between the trolling motor and a larger motor used for high speed propulsion of the vessel;

FIG. 2 is a fragmentary sectional view showing the connection of the cable of the steering apparatus to a steering rod within the tilt tube of the trolling motor;

DETAILED DESCRIPTION OF THE PREFERRED EMBODIMENTS

Figure 3:
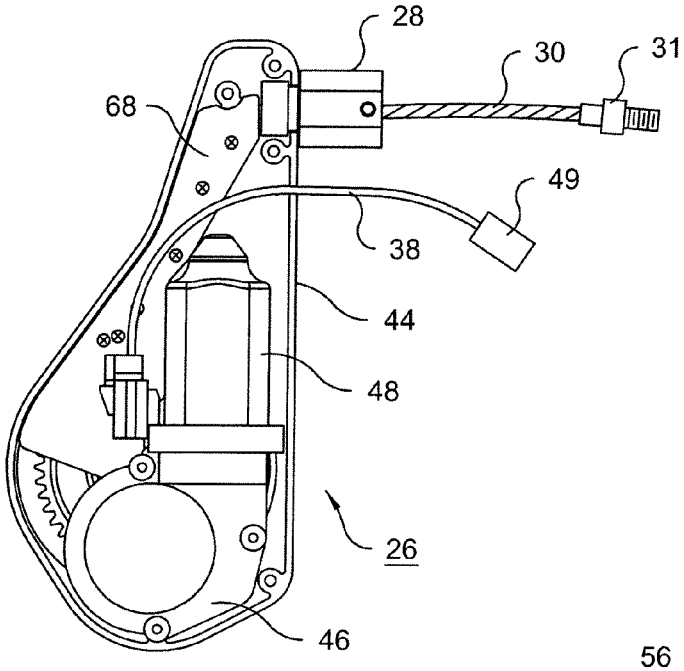
FIG. 3 is a top plan view of the steering apparatus with its cover removed.

As shown in FIG. 1, an outboard motor-propelled vessel 10, for example a bass fishing boat, is equipped with both a large outboard motor 12 and a smaller trolling motor 14, mounted in spaced, side-by-side relationship on the transom 16 at the stern.

Outboard motor 12 is mounted by means of a bracket 18 on which a so-called "tilt tube" 20 is provided. The motor can be tilted about the axis of the tilt tube to lift the rudder and propeller (not shown) out of the water.

The trolling motor 14 is similarly mounted on the transom by means of a bracket 22, and is also provided with a tilt tube 24.

The steering apparatus 26 is mounted at one end of tilt tube 24, preferably at a location between the two outboard motors, by means of a fitting 28, which can be threaded onto the tilt tube. As shown in FIG. 2, a rod 29, extending into the tube through the opposite end thereof, is coupled by a fitting 31 to a cable 30 that emerges from the steering apparatus through fitting 28, and is linked to the motor 14 by another rod 32, which controls pivoting of the motor about a vertical, or substantially vertical, steering axis.

Returning to FIG. 1, the steering apparatus, which includes a reversible DC motor (not shown in FIG. 1), is powered by a storage battery 34 through a connection box 36 and a cable 38. A hand-held control module 40 is connected to the box 36 by a long flexible cable 42, which enables an operator to steer the boat from any of various positions in the boat while it is being propelled by the trolling motor 14. The control module 40 includes switches that can delivery of battery current to the DC motor in either of two polarities and also cut off delivery of battery current. The control module can also include a throttle control (not shown) for adjusting the speed of motor 14. Although the trolling motor will usually be a gasoline-powered motor, an electric trolling motor provided with a tilt tube can be used as an alternative, and can be steered by a steering apparatus similar to the steering apparatus described herein. In that case, the battery 34 can be the same battery used to power the trolling motor.

Although the control module shown is connected through a cable 42, a wireless control module can be used as an alternative.

As shown in FIG. 3, the steering apparatus 26 comprises a housing 44 in which is mounted a drive unit 46 comprising a reversible DC motor 48 to which electric power is delivered through cable 38. A connector 49 is provided on cable 38 for connection to connection box 36.

Figure 4:
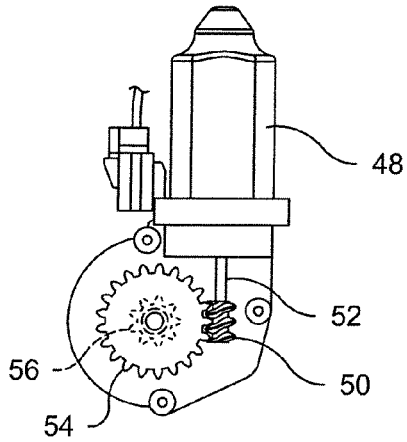
FIG. 4 is a top plan view showing the electric motor and parts of the reduction gearing.
Figure 5:
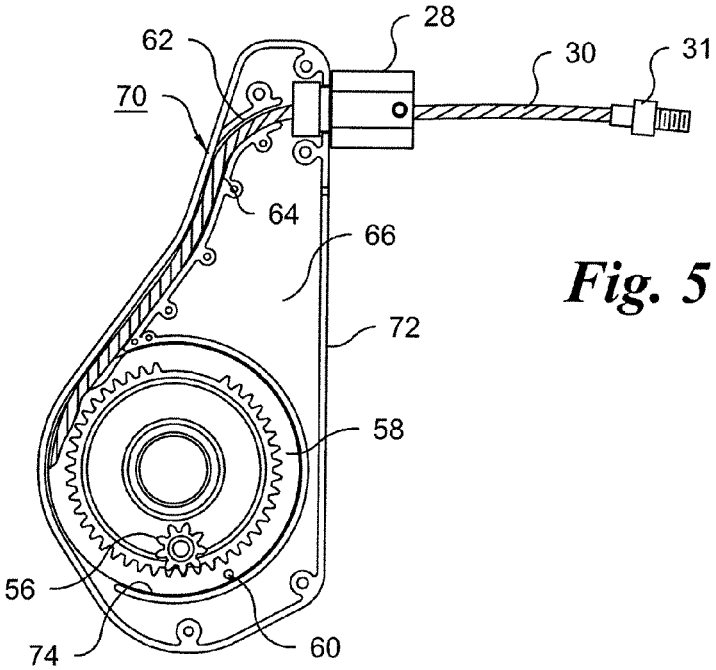
FIG. 5 is a top plan view of the steering apparatus with the electric motor, and part of the reduction gearing and cable guide cover removed in order to expose the reel, the reel drive pinion, and the cable guide.

As shown in FIG. 4, a worm gear 50 on the shaft 52 of motor 48 is in mesh with a toothed wheel 54. The toothed wheel is fixed to a pinion 56 which, as shown in FIG. 5, is in mesh with the teeth of an internally toothed reel 58 having an external groove for receiving cable 30. Cable 30 is wound around the reel through nearly a full turn when the cable is in its fully withdrawn condition as shown in FIG. 5, and secured to the reel at a location near an end of the cable by a pin 60.

Cable 30 is a multi-strand cable, preferably of stainless steel or other corrosion-resistant material. The cable should have sufficient tensile strength to steer outboard motor 14 in one direction, and a sufficient stiffness to transmit the compressive force required to steer outboard motor 14 in the opposite direction.

Figure 6:
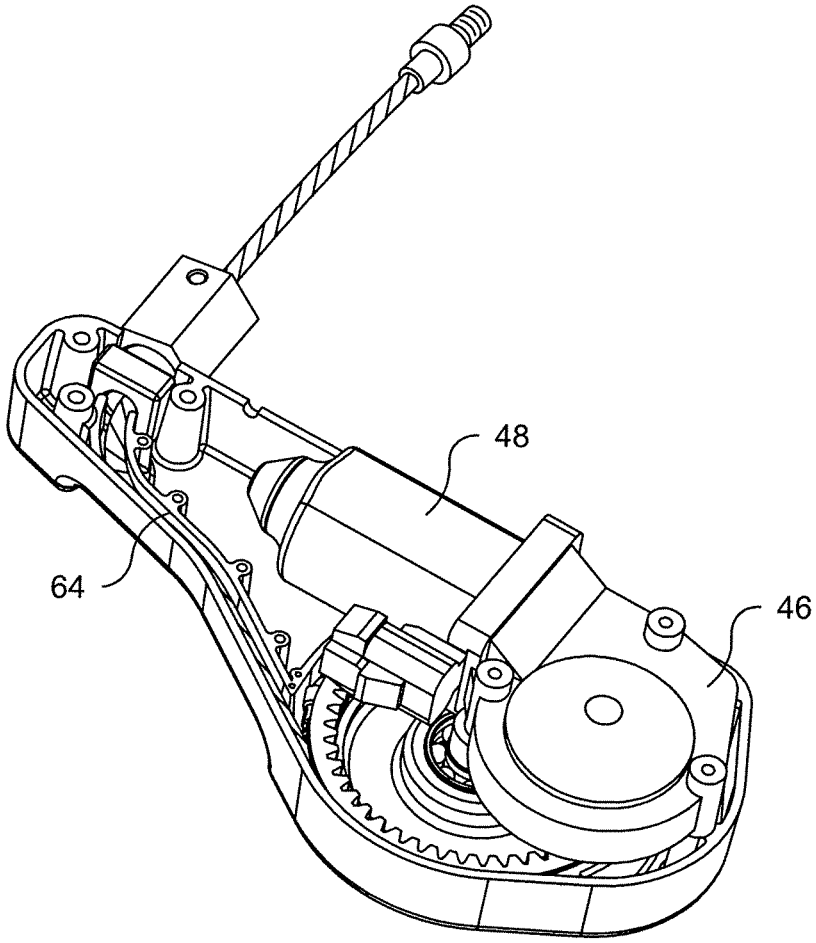
FIG. 6 is an oblique perspective view of the steering apparatus with its cover removed.

To guide the portion of cable 30 that extends from the reel 58 to the fitting 28, the housing 58 is formed with a guide channel defined by parallel internal walls 62 and 64, which are spaced from each other by a distance slightly greater than the diameter of the cable, and a bottom wall constituted by a part of the bottom wall 66 of the housing. The channel is covered by a cover 68 (FIG. 3) to form an enclosed cable guide passage when the steering apparatus is fully assembled, but is shown in FIGS. 5 and 6 with the cover 66 removed. The distance between the cover 68 and bottom wall 66 should also be only slightly greater than the diameter of the cable.

The cable guide passage is formed with a gradual outward curvature from a location adjacent the reel to an intermediate location 70 near the fitting 22 through which the cable extends outward from the housing. From that intermediate location 70, the guide passage curves inward so that the cable extends from the housing in a direction substantially perpendicular to a side wall 72 of the housing. Thus, the path of the cable has a first part extending from a location adjacent the reel to the intermediate location 70, and a more sharply curved second part, extending from the intermediate location 70 to a location adjacent fitting 24. The first part of the cable path is longer than the second part, and the second part of the cable path has a curvature such that the radii of curvature of all parts of the second part are smaller than any radius of curvature of the first part. This configuration of the cable path enables the cable to extend from the housing in a direction transverse, and preferably substantially perpendicular, to the longest dimension of the housing, so that the housing can be installed between two outboard motors that are mounted close together on a boat transom.

The housing includes a curved internal wall 74 extending around a portion of the perimeter of the reel and in close proximity to the part of the flexible cable wound on the reel. This internal wall constrains the part of the flexible cable wound on the reel against radial expansion as the cable is unwound from the reel.

Various modifications can be made to the steering apparatus. For example, the shape and length of the cable path inside the housing can be modified in various ways, and, with a suitable modification to the cable guide passage, the cable can be made to extend from a housing in a direction transverse to the plane defined by the portion of the cable wound onto the reel. However, for simplicity of construction, it is preferred that all parts of the cable, including the part wound onto the reel, be situated in a single plane as shown in the drawings. Although in the embodiment described, the maximum length of the portion of the cable wound onto the reel is less than the circumference of the reel, it is possible to utilize an arrangement in which more than one full turn of the cable is wound around the reel, and in that case the diameter of the reel can be reduced. Although the reel described is formed with internal gear teeth, in an alternative embodiment, the reel can be equipped with external gear teeth axially offset from the portion of the reel onto which the cable is wound.

What is claimed is:

1. Apparatus for steering a vessel propelled by an outboard motor comprising:

a housing;

a first fitting on the housing for attachment to one end of a tilt tube of an outboard motor, the first fitting having an internal passage for providing communication between the interior of the housing and the interior of a tilt tube to which the fitting is attached;

a reel within the housing and mounted for rotation therein;

a reversible electric motor;

reduction gearing connecting the motor in driving relationship to the reel; and a flexible cable wound on the reel and extending therefrom through the internal passage of the fitting, a part of the cable adjacent one end thereof being fixed to the reel, and the cable having an opposite end external to the housing; and a second fitting on said opposite end of the cable for attachment, within the tilt tube, to a rod protruding from the interior of the tilt tube through the opposite end thereof;

wherein the cable has sufficient stiffness to exert a pushing force on the rod when the reel is rotated in a direction to unwind the cable therefrom;

whereby, by linking the protruding portion of the rod to the outboard motor, the outboard motor can be steered by operation of the reversible electric motor.

2. Apparatus according to claim 1, wherein the reel is constrained for rotation about a first axis in fixed relation to the housing, and wherein the internal passage of the first fitting extends from the interior of the housing to the exterior of the housing along a second axis spaced from the first axis.

3. Apparatus according to claim 1, wherein the reel is constrained for rotation about a first axis in fixed relation to the housing, and wherein the internal passage of the first fitting extends from the interior of the housing to the exterior of the housing along a second axis spaced from the first axis, the second axis being disposed in a plane to which the first axis is perpendicular.

4. Apparatus according to claim 1, wherein the first fitting is spaced from the reel, and wherein the housing includes a cable guide passage constraining the portion of the cable extending from the reel to the first fitting to a predetermined path within the housing.

5. Apparatus according to claim 1, wherein the housing includes a curved internal wall extending around a portion of the perimeter of the reel and in close proximity to the part of the flexible cable wound on the reel and constraining said part of the flexible cable wound on the reel against radial expansion as the cable is unwound from the reel.

6. Apparatus according to claim 1, wherein the first fitting is spaced from the reel, wherein the housing includes a cable guide passage constraining the portion of the cable extending from the reel to the first fitting to a predetermined path within the housing, and wherein the housing includes a curved internal wall extending around a portion of the perimeter of the reel and in close proximity to the part of the flexible cable wound on the reel and constraining said part of the flexible cable wound on the reel against radial expansion as the cable is unwound from the reel.

7. Apparatus according to claim 1, wherein the first fitting is spaced from the reel, the housing includes a cable guide passage constraining the portion of the cable extending from the reel to the first fitting to a predetermined path within the housing, said path has a first part extending from a location adjacent the reel to an intermediate location and a second part extending from said intermediate location to a location adjacent the first fitting, the first part of said predetermined path is longer than the second part thereof, said second part of the predetermined path has a curvature, and the radii of curvature of all parts of said second part are smaller than any radius of curvature of the first part.

8. Apparatus according to claim 1, wherein the reel is constrained for rotation about a first axis in fixed relation to the housing, wherein the internal passage of the first fitting extends from the interior of the housing to the exterior of the housing along a second axis spaced from the first axis, the second axis being disposed in a plane to which the first axis is perpendicular, and wherein the dimension of the housing along said second axis is narrower than the dimension of the housing along a direction parallel to said second axis at the location of said first axis.

9. Apparatus according to claim 1, wherein the reversible electric motor is also located within the housing.

10. In a vessel propelled by an outboard motor mounted on the stern thereof, the outboard motor having a tilt tube, a steering apparatus comprising:

a housing;

a first fitting on the housing attached to one end of the tilt tube of said outboard motor, the first fitting having an internal passage providing communication between the interior of the housing and the interior of said tilt tube;

a reel within the housing and mounted for rotation therein;

a reversible electric motor;

reduction gearing connecting the motor in driving relationship to the reel; and a flexible cable wound on the reel and extending therefrom through the internal passage of the fitting, a part of the cable adjacent one end thereof being fixed to the reel, and the cable having an opposite end external to the housing; and a second fitting on said opposite end of the cable;

a rod protruding from the interior of the tilt tube through the opposite end thereof and attached, within the tilt tube, to said second fitting;

wherein the cable has sufficient stiffness to exert a pushing force on the rod when the reel is rotated in a direction to unwind the cable therefrom; and a link connecting the protruding portion of the rod to the outboard motor, whereby the outboard motor can be steered by operation of the reversible electric motor.

11. A vessel according to claim 10, wherein said outboard motor is a first outboard motor, and including a second outboard motor mounted on the stern of said vessel in side-by-side relationship to said first outboard motor, wherein at least a part of the housing of said steering apparatus is located between said outboard motors.

12. A vessel according to claim 10, wherein said outboard motor is a first outboard motor, and including a second outboard motor mounted on the stern of said vessel in side-by-side relationship to said first outboard motor, wherein the reel is constrained for rotation about a first axis in fixed relation to the housing, wherein the internal passage of the first fitting extends from the interior of the housing to the exterior of the housing along a second axis spaced from the first axis, the second axis being disposed in a plane to which the first axis is perpendicular, wherein the dimension of the housing along said second axis is narrower than the dimension of the housing along a direction parallel to said second axis at the location of said first axis, and wherein at least the part of said housing having said narrower dimension is located between said outboard motors.

* * * * *